United States Patent [19]

Vetter

[11] 4,143,854

[45] Mar. 13, 1979

[54] JACKING DEVICE

[76] Inventor: Manfred Vetter, D-5352 Zuelpich, Burg Langendorf, Fed. Rep. of Germany

[21] Appl. No.: 818,661

[22] Filed: Jul. 25, 1977

Related U.S. Application Data

[63] Continuation of Ser. No. 574,871, May 6, 1975, abandoned.

[51] Int. Cl.[2] ..... B66F 3/24

[52] U.S. Cl. ..... 254/93 HP

[58] Field of Search ..... 254/93 HP; 4/18 L

[56] References Cited

U.S. PATENT DOCUMENTS

| | | | |
|---|---|---|---|
| Re. 24,272 | 2/1957 | Albee | 254/93 HP |
| 1,752,101 | 3/1930 | Meutsch | 254/93 HP |
| 2,495,092 | 1/1950 | Cox et al. | 254/93 HP |
| 2,990,166 | 6/1961 | Walsh | 254/93 HP |
| 3,305,217 | 2/1967 | Wijgergangs | 254/93 HP |

*Primary Examiner*—Robert C. Watson

*Attorney, Agent, or Firm*—Stevens, Davis, Miller & Mosher

[57] ABSTRACT

A fluid jacking device which includes a multiwall pressure and fluid-tight envelope provided with fabric reinforcements and enclosing a volume which changes when the internal pressure is varied, and a connector fitted into the envelope for joining its interior to a pressure supply. The envelope consists of at least one pair of possibly specially strengthened panels made of at least one ply of a flexible high strength material. The panels of each pair are integrally joined together at least one edge by lapping the plies with the possible provision of at least one reinforcing strip applied to the joint.

20 Claims, 10 Drawing Figures

JACKING DEVICE

This is a continuation of application Ser. No. 574,871 filed May 6. 1975, now abandoned.

The invention relates to a pneumatic or hydraulic jacking device comprising a multiwall pressure and fluid tight envelope provided with fabric reinforcements and enclosing a volume which changes when the internal pressure is varied and a connector fitted into the envelope for joining its interior to a pressure supply.

Pneumatic jacking devices of this type have already been described in the specification of German Petty Patent No. 7,143,405. They have the form of inflatable containers with a reinforced bottom and head plates connected by a containing wall and retaining members for limiting the distance between the two plates. Bottom and head plate consist of several layers of the same airtight fabric which also forms the containing side wall. This consists preferably of a polyamide fabric (particularly nylon) rendered airtight by an impregnation of synthetic rubber (particularly vulcanised Neoprene). Such a material is mechanically very strong besides being resistant to attack by oil and gasoline.

In order to achieve a satisfactory degree of inherent stability, improved bursting pressures and a restricted lift, these known jacking devices have the ends of a number of substantially inelastic tapes of equal length anchored between the layers of floor plate and head plate to limit the maximum distance the plates can separate, and preferably elastic tapes are also interposed at regular intervals between the substantially inelastic tapes. Moreover, it is also preferred to provide at least one elastic tape which pulls the containing sidewall inwards.

Practical forms of construction of these known jacking devices are of relatively bulky size to enable them to raise even heavy loads fairly considerable vertical distances with the aid of only low internal pressures. An internal pressure of about 0.5 bars in a jacking device having a plate diameter of 76 cms is thus capable of lifting a load of 2 tonnes by about 60 cms. Their size also permits such jacking devices to be used on rough and soft ground. The large bearing surface and the flexibility of the jacks enables even flat panelwork on motor vehicle bodies, large surface tanks etc. to be lifted and squeezed and the thickness of the bottom and head plates, which may be as much as 9 mm, permits such jacks to be applied even to objects which have jagged edges.

Nevertheless, these advantageous features of the known jacking devices also limit their applicational range. Objects contemplated by the present invention therefore include further reducing the dimensions of such jacking devices, particularly their height when they are fully collapsed and at the same time minimising the time needed for their inflation, besides raising their bursting strength and hence their lifting capacity.

A jacking device according to the present invention consists of one or more pairs of possibly strengthend panels made of a flexible high strength material, in which the panels of each pair are either integrally connected or joined together at least at one edge by lapping or splicing the plies with the possible provision of one or more reinforcing strips applied to or inserted into the joint.

The term "integrally connected" as used in the present context is understood to mean that the junctions between the plies exhibit no change or at least no significant change in structure or discontinuity in the material. In other words, the plies are connected because they and their reinforcement are formed by the same single sheet, or they are homogeneously joined for instance by vulcanisation or fusion or by being a circular weave and so forth.

A joint between two panels can be formed by the edge at the joint being lapped by one or more additional strips of material or by strips formed from the one and/or the other panel. Even if the panels merge continuously or integrally the edges which are critical zones from the point of view of bursting pressure may be provided with such reinforcing strips. The reinforcing strips may be adhesively bonded, hot sealed or bonded in some other way, for instance by polymerisation, vulcanisation or the like to the material forming the panels. The same applies to the individual plies of these materials which are to be connected together or bonded to the edging strips.

Jacking devices according to the invention are suitable for lifting the heaviest weights, for breaking open doors, for releasng persons trapped in motor vehicles, for rendering assistance when adjusting and levelling machinery and so forth. When deflated and collapsed the proposed jacking devices are only a few millimetres high so that they can be inserted into very small clearances. They can be inflated in a few seconds and, because of their high bursting strength which exceeds that of the above described known jacking devices by a multiple and the resultant much higher maximum pressure of expansion, they are also capable of developing much greater lifting power.

This will be readily understood from the following Table which contains data of a number of practical embodiments of the proposed jacking devices:

| | 1 | 2 | 3 | 4 | 5 |
|---|---|---|---|---|---|
| Lifting capacity in tonnes optimal | 7.35 | 9.00 | 13.50 | 18.00 | 18.00 |
| Dimensions in cms | 35 × 35 | 50 × 50 | 50 × 45 | 50 × 60 | 100 × 30 |
| Lifting height, optimal in cms | 22 | 16 | 27 | 27 | 16 |
| Capacity in litres | 8 | 8 | 18 | 33 | 16 |

Other advantages and features of the invention will be understood from appendant claims and as the following more particular description of the invention proceeds, in which reference will be made to the drawing which shows three embodiments of a high pressure jacking devices according to the invention.

In the drawing

Figure 1:
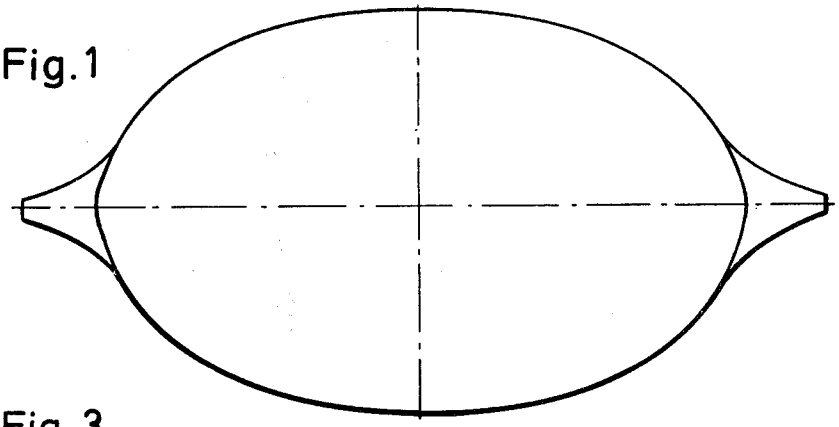
FIG. 1 is a cross section of a first embodiment of a jacking device according to the invention, the jack being shown in the inflated state.

Reference will first be made to the Figures of the drawing in a general way.

All the embodiments comprise an inner envelope and an outer envelope. However, it will be understood that a jacking device according to the invention could be formed from only one envelope or from more than two envelopes, provided a fluid-tight and pressure-resistant connection between the components of the envelopes were assured in these or at least in one of the envelopes.

The jacking device consists of an envelope which may be pillow-shaped or it may have some other geometrical shape, for instance cylindrical.

Figure 2:
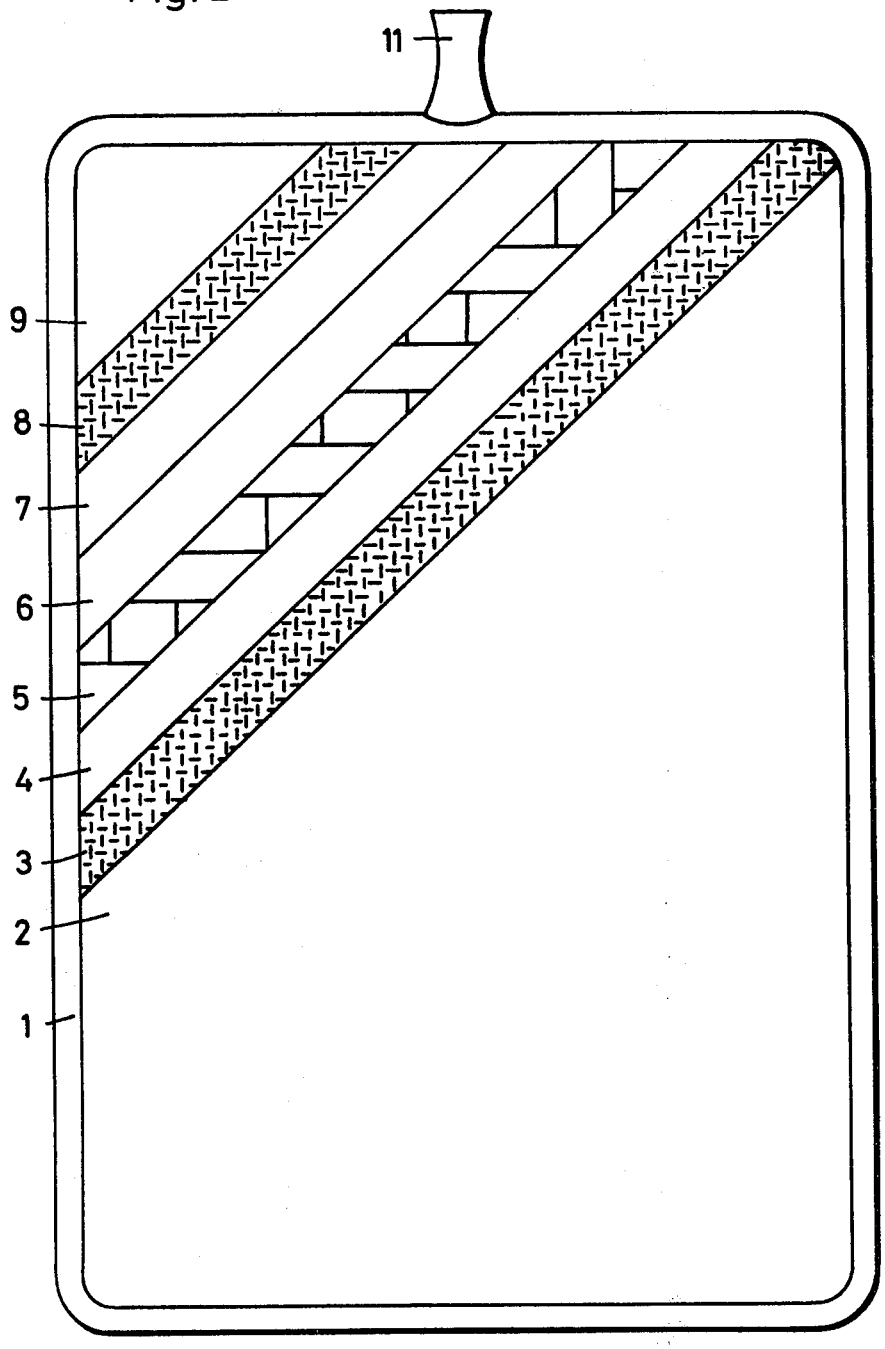
FIG. 2 is a top view of the jacking device according to FIG. 1 in the deflated flattened state, the drawing showing the several plies of the wall structure stripwise exposed.

In the embodiment illustrated in FIGS. 1 and 2, the jacking device consists of two panels preferably of like construction and equal size which are firmly joined together around their peripheries 1 or which may continuously merge. The outside ply 2 is a skin of Neoprene which is characterized by possessing considerable resistance to chemical attack and to wear. All seams or lap joints are sealed by vulcanisation. Adhesively bonded to the Neoprene skin is a fabric 3 which is a twill weave containing 5 ends and 5 picks per cm and which is made of a 4000 denier multi-filar Nylon yarn. Underneath the fabric ply 3 is another Neoprene ply 4 and the inside of this ply 4 is backed with tapes consisting of adhesively secured inelastic webbing 25 mm wide and spaced 30 mm apart. The tapes continue without interruption around the peripheral edge 1 into the panel on the other side and thus form a continuously enveloping longitudinal and transverse reinforcement. The tapes 5 are covered by another Neoprene ply 6 which thus completes a fully pressure-tight and fluid-tight flexible but substantially non-stretch bag. Optionally the inside surface of this bag — with the possible interposition of a film of adhesive 7—may be lined with another fabric ply 8 and/or another rubber ply 9. At one point on the periphery the wall of the bag is traversed by a connector for joining the bag to a hose for the supply of a pressurised fluid. The disposition and arrangement of this connector are also such that the wall of the bag is not mechanically weakened by the presence of the connector.

If layers of thermoplastic material for instance in the form of strips or monofils of synthetic plastics material such as polyesters and polyamides are provided it is preferred to make these endless by hot sealing or by high frequency bonding because seams thus produced are not or they are only slightly inferior in strength to the material itself. Materials which cannot be fused can nevertheless be joined by fusion techniques by the insertion of a foil of thermoplastic material.

The material of the several plies, i.e. of the rubber and fabric plies as well as of the tapes may be used in the form of suitably cut sections, but care must than be taken to see that the edges are securely seamed, any laps being so placed that they do not form stacks and thus increase the thickness of the jack when collapsed. Conveniently the plies are used in endless form, for instance as a tubular weave or a continuous winding or they may be formed seamlessly at the point of assembly for instance by polymerising a resin in a ply which may contain reinforcing insertions such as wire coils and the like.

A further increase in wall strength can be achieved by the provision of additional insertions, such as of an elastically flexible steel sheet material in flat or dished shape, of wire mesh, panels of belts. It has been found that the employment of a weave reinforced by the incorporation of a metal wire in weft and/or warp is extremely suitable.

Figure 3:
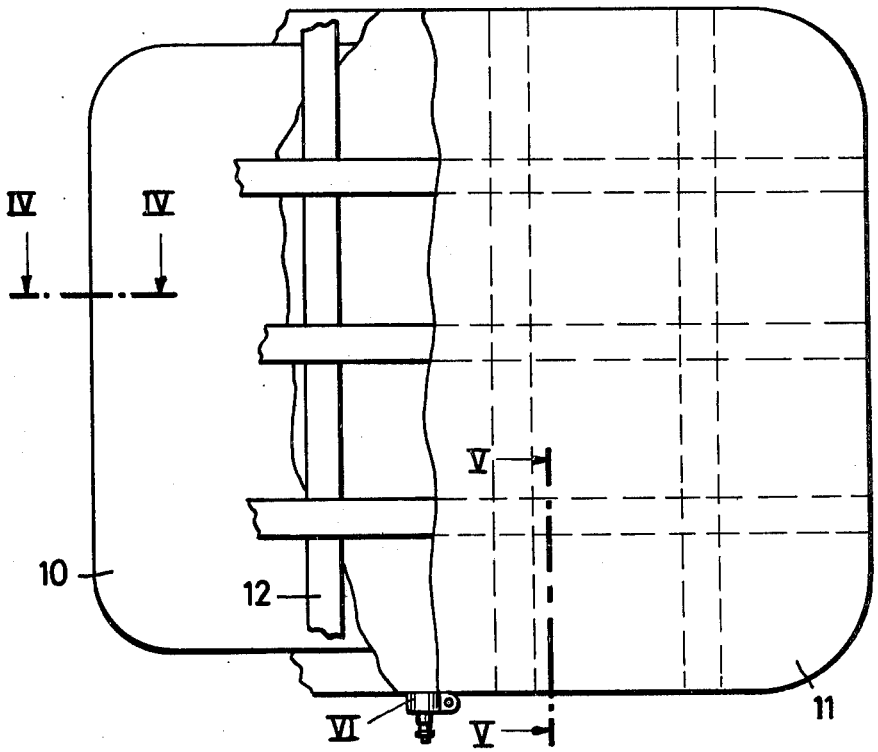
FIG. 3 is a top view of a second embodiment of a jacking device according to the invention in the deflated flattened down state, consecutive plies being likewise exposed to reveal the wall structure.

FIG. 3 illustrates another embodiment of a jacking device according to the invention. This comprises an internal bladder 10 and an external pillow-shaped case 11. The external case 11 is reinforced by a system of tapes 12. For making the external case 11 oblong or square sections with rounded corners of so-called conveyor belting can be used, which may consist for instance of several plies in the order Neoprene, Nylon, Neoprene, Cotton or Nylon, Neoprene. Alternative sequences of the plies would be entirely feasible, say Neoprene, Nylon, Cotton, Nylon, Neoprene. Moreover, the number of plies may also be further increased.

Figure 4:
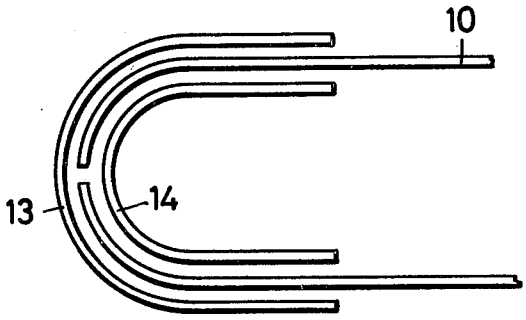
FIG. 4 is a section taken on the line IV—IV in FIG. 3.

The internal bladder 10 is of integral construction and made of a fluid and pressure-tight rubber strengthened around the edges of the case by the application thereto of adhesively bonded or vulcanised strip material 13 and 14. (FIG. 4).

Figure 5:
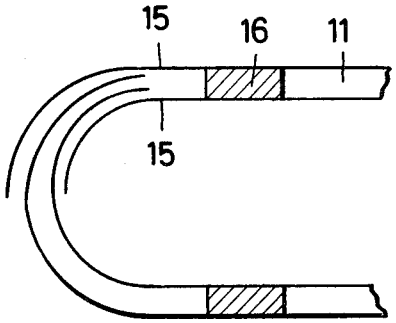
FIG. 5 is a section taken on the line V—V in FIG. 3.

FIG. 5 shows how the outside panels of the case 11 are joined at their edges. The panels each comprise an inner and an outer layer of rubber 15 separated by Nylon fabric strips 16. The edges of the rubber plies 15 are alternately lapped or — as illustrated in FIG. 5— they may be lapped in pairs.

Figure 6:
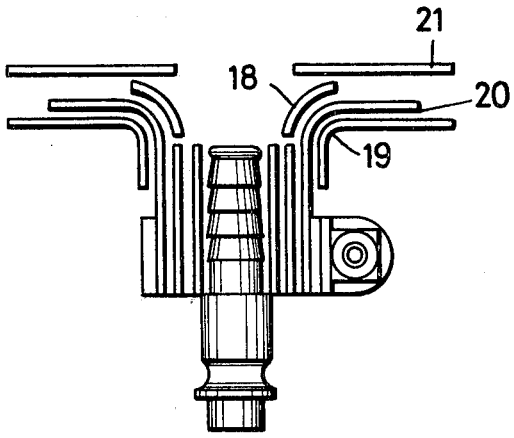
FIG. 6 is a section on a larger scale of a connector indicated at VI in FIG. 3 for joining the end of a pressure supply pipe to the jacking device.

For the incorporation of the connector for a pressure supply pipe (not shown) this embodiment is formed with a special nipple 17 integrated into the structure by a suitable arrangement of the plies of the wall, as shown in FIG. 6. 18 and 19 are reinforcing strips which serve the same purpose as the above described reinforcing strips 13 and 14, whereas the layers 20 and 21 correspond to the above mentioned envelopes 10 and 11. Safe anchorage of the nipple can also be secured by the particular geometrical design of the nipple itself, possibly supplemented by accessory members, the nipple thus constituting a suitably shaped component.

Figure 7:
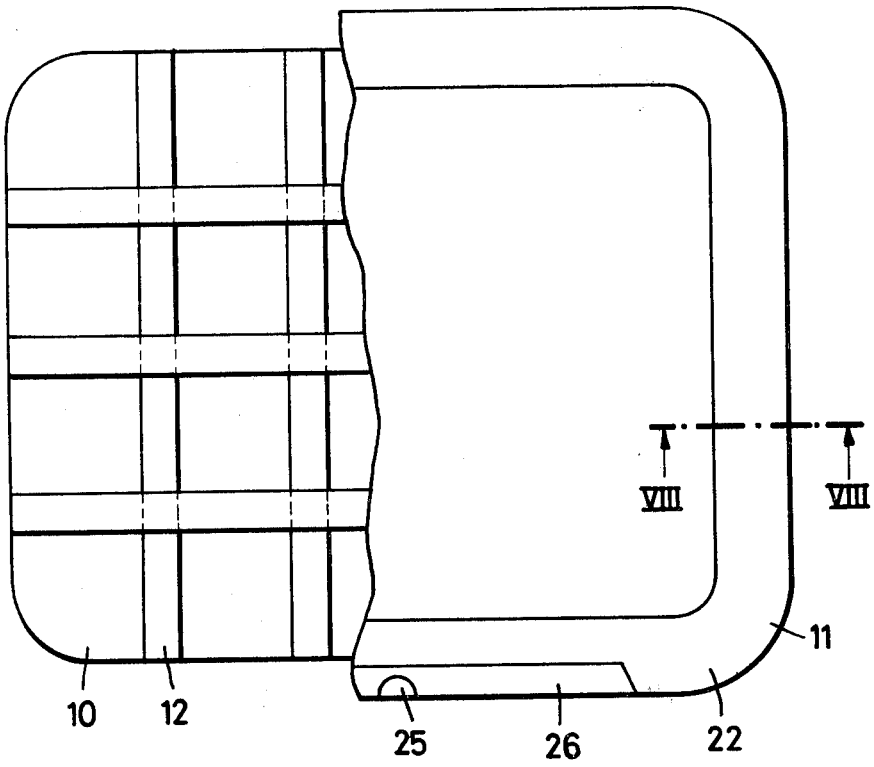
FIG. 7 is a part sectional top view of a third embodiment of a jacking device according to the invention.
Figure 8:
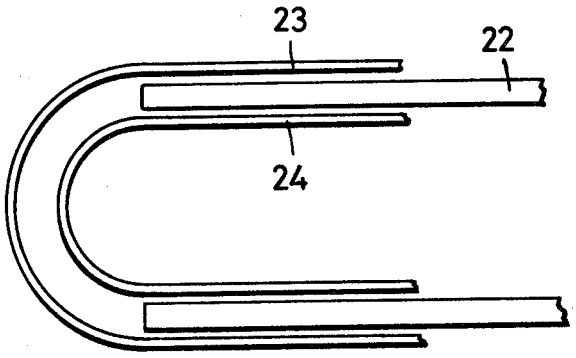
FIG. 8 is a section taken on the line VIII—VIII in FIG. 7.

FIGS. 7–8 is an inverse form of construction to that previously described, the inside bladder 10 being here provided with the tape reinforcement 12, whereas the two panels 22 of the outer case 11 are joined together by edge reinforcing strips 23, 24 covering the inside and outside of the peripheral edge. At 25 where the nipple for the pressure supply pipe (not shown) projects through the edge of the outer case 11 one of the panels 22 is provided with a strip-shaped fin 26 which is folded over the cooperating panel 22 and bonded thereto.

The tapes 12 are non-stretch webs spaced 60 mm apart and continuing without a break over the edge from one side of the bag to the other thus forming an embracing reinforcement. As in the previous embodiments the tapes may be located on the inside, the outside or within the panels forming the jacking device, or — if several panels are provided — they may be located in any desired arrangement on one, several or all of them. Tapes could be replaced by a reinforcement made of some sheet-like material, for instance the same material as that used for making the envelope(s).

Finally the internal tapes may be designed to limit the lift, as described in the specification of the previously mentioned German Petty Patent.

If the fabric plies are circularly woven tubes or circularly woven bands it is desirable in the case of a cushion-shaped bag to provide additional reinforcing strips or other dish-shaped parts, for instance in the case of cylindrical containers, at least in the corner zones of the outside edges. By connecting each of the selvedges of the circularly woven tube to one closely sealing cover member a very convenient car jack can be formed which is easily stored and readily operated by making use of the exhaust gases of the engine, of a compressed gas cylinder or of a pump.

This modification of the invention thus has the shape of a circular (particularly a cylindrical) or sac-shaped bellows.

Figure 9:
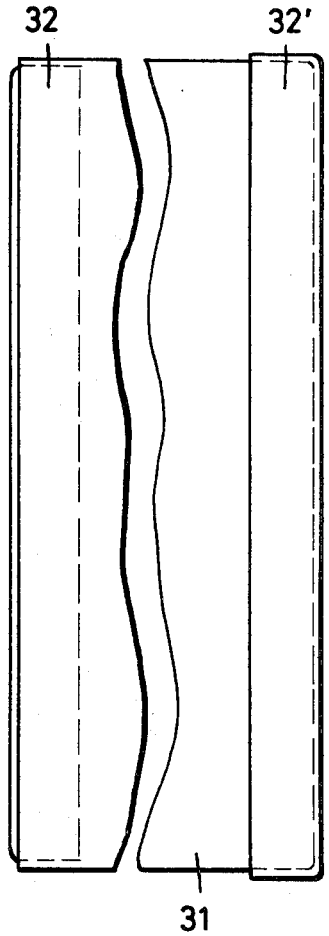
FIGS. 9 and 10 are schematic representations of two other embodiments of the invention.

FIG. 9 is a schematic axial section of another embodiment of the invention in which the jacking device is formed substantially from an impregnated circularly woven tube 31 and two plate-shaped covers 32, 32' made of a tough material embracing the two ends of the fabric tube 31 in a manner creating pressure and fluid-tight joints, besides being so dimensioned that their flanges interfit when the cylinder is fully collapsed.

Figure 10:
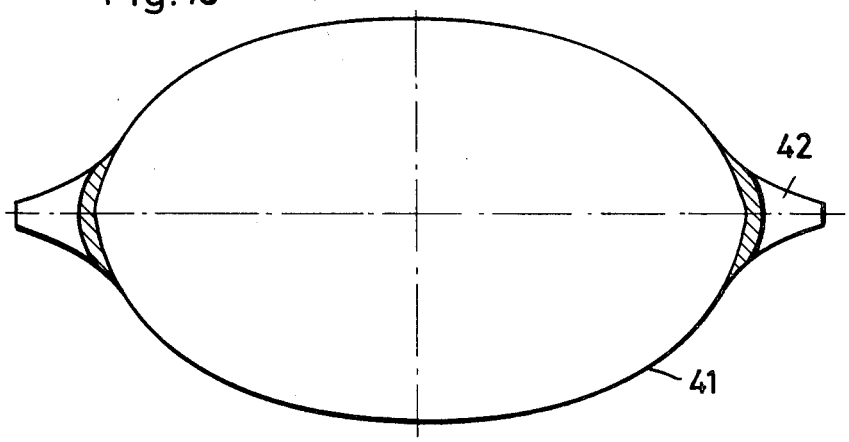

FIG. 10 is a section similar to that in FIG. 1 of a cushion-shaped bag. However, this consists of a circularly woven tube 41 having ends tightly sealed, the joining of the edges being assured or assisted by a shaped member 42 provided at least at the corners of the cushion-shaped bag.

I claim:

1. A fluid jacking device comprising a multiwall pressure and fluid-tight envelope provided with metal wire containing fabric reinforcements and enclosing a volume which changes when the internal pressure is varied, and a connector fitted into the envelope for joining its interior to a pressure supply, said envelope consisting of at least one pair of panels made of at least five plies of flexible high strength material, such said ply being composed of one of neoprene, fabric and rubber, said panels of each pair being integrally joined together at least at one edge by lapping the plies at the juncture of said panels with at least one reinforcing strip applied to the joint.

2. The jacking device according to claim 1, wherein the panels are oblong.

3. The jacking device according to claim 1, wherein the panels are round.

4. The jacking device according to claim 1, wherein at least one panel contains at least one ply of a non-stretch woven fabric.

5. The jacking device according to claim 4, wherein the woven fabric is impregnated.

6. The jacking device according to claim 4, wherein the woven fabric is coated.

7. The jacking device according to claim 4, wherein the woven fabric includes metal wires in at least one of its warp and weft.

8. The jacking device according to claim 4, wherein the woven fabric is in the form of a circularly woven tube.

9. The jacking device according to claim 4, wherein the woven fabric is hot sealed along at least one seam.

10. The jacking device according to claim 1, including at least one rubber ply.

11. The jacking device according to claim 1, including at least one ply of tanned leather in sheet form.

12. The jacking device according to claim 1, including at least one ply of tanned leather in band form.

13. The jacking device according to claim 1, including at least one sheet metal reinforcement.

14. The jacking device according to claim 13, wherein the sheet metal reinforcement is an elastically flexible steel sheet material.

15. The jacking device according to claim 1, including at least one metal wire reinforcement.

16. The jacking device according to claim 1, wherein the reinforcement is a wire coil.

17. The jacking device according to claim 16, characterized in that at least one side of at least one ply is provided with tapes adhesively bonded thereto and running in the lengthwise direction.

18. The jacking device accoreing to claim 15, characterized in that at least one side of at least one ply is provided with spaced tapes adhesively bonded thereto and running in the crosswise direction.

19. The jacking device according to claim 4, wherein the plies are connected together by fusing the fabric.

20. The jacking device according to claim 6, wherein the plies are connected together by coatng the fabric.

* * * * *